United States Patent [19]

Olsen et al.

[11] Patent Number: 4,569,659

[45] Date of Patent: Feb. 11, 1986

[54] REFRACTORY LINING FOR A FURNACE

[75] Inventors: Erik T. Olsen; Ingvar G. A. Blom, both of Nyhamnsläge, Sweden

[73] Assignee: Höganäs AB, Höganäs, Sweden

[21] Appl. No.: 439,122

[22] Filed: Nov. 4, 1982

[30] Foreign Application Priority Data

Nov. 19, 1981 [SE] Sweden ..... 8106899

[51] Int. Cl.[4] ..... F27B 7/28

[52] U.S. Cl. ..... 432/119; 110/336; 432/118

[58] Field of Search ..... 116/336, 337; 432/118, 432/119; 52/379, 713

[56] References Cited

U.S. PATENT DOCUMENTS

| | | | |
|---|---|---|---|
| 2,021,610 | 11/1935 | Quint . | |
| 3,396,504 | 8/1968 | Oliveira | 110/336 X |
| 3,563,521 | 2/1971 | Olsen . | |
| 3,592,454 | 7/1972 | Olsen . | |
| 3,836,612 | 9/1974 | Mann | 264/30 |
| 3,982,953 | 9/1976 | Ivarsson et al. . | |
| 4,107,890 | 8/1978 | Seghezzi | 110/336 X |
| 4,244,745 | 1/1981 | Havranek et al. . | |

FOREIGN PATENT DOCUMENTS

| | | | |
|---|---|---|---|
| 320701 | 5/1970 | Austria . | |
| 0004756 | 10/1979 | European Pat. Off. . | |
| 914831 | 12/1954 | Fed. Rep. of Germany | 432/119 |
| 1254803 | 11/1967 | Fed. Rep. of Germany . | |
| 1922679 | 5/1969 | Fed. Rep. of Germany . | |
| 2541447 | 9/1979 | Fed. Rep. of Germany . | |
| 2298779 | 1/1976 | France . | |
| 525605 | 3/1975 | Japan . | |
| 102022 | 7/1941 | Sweden . | |
| 114682 | 8/1945 | Sweden . | |
| 7702864 | 3/1977 | Sweden . | |
| 422025 | 1/1935 | United Kingdom | 110/336 |
| 999521 | 8/1963 | United Kingdom . | |
| 903675 | 6/1980 | U.S.S.R. | 432/119 |

*Primary Examiner*—Edward G. Favors

*Attorney, Agent, or Firm*—Burns, Doane, Swecker & Mathis

[57] ABSTRACT

The invention relates to a lining for a furnace (1). The lining consists of pre-fabricated refractory ceramic anchoring elements (6, 7, 14), containing the fastening irons necessary for attaching the lining to the sheet mantle (5) and a refractory ceramic casting mass (8) between the anchoring elements for forming a monolithic lining. When relining the furnace the removal of the old lining is facilitated by first rupturing the anchoring elements.

6 Claims, 4 Drawing Figures

REFRACTORY LINING FOR A FURNACE

TECHNICAL FIELD

The invention relates to a lining of a furnace, for example a cement rotary furnace with coolers and by-pass channels or walls in a walking beam furnace.

TECHNICAL FIELD

Refractory linings in furnaces are often made by casting with a refractory casting mass. The walls of the furnace consist of steel sheet which is a natural outer casting mould. Anchoring irons of heat-resistant flat steel bars are welded into the steel sheet and the purpose of said bars is to keep the refractory lining in its position.

The quality of casting masses and anchoring irons have been progressively improved so as to increase their working life. At the same time, however, the difficulty in removing the old lining for relining purposes has increased.

THE INVENTION

The lining according to the invention is designed in such a manner that future removal in connection with relining will be facilitated. It is characterized thereby that the anchoring irons are cast into pre-fabricated conical, pyramid or wedge-shaped ceramical elements, preferably having a cross-section increasing in direction from the furnace wall. The anchoring elements are attached to the wall of the furnace by a through-going bolt and a nut or are keyed onto sheet forks welded into the walls of the furnace.

A refractory ceramic casting mass is cast between the anchoring elements to a thickness in level with the tops of the anchoring elements to form a coherent monolithic lining. The anchoring elements as well as the intermediate casting are made from a refractory casting mass, for example according to U.S. Pat. No. 3,982,953, the disclosure of which is incorporated herein by reference.

In rotary furnaces having a cylindrical mantle no inner mould wall is usually required. The casting can take place against the furnace which temporarily constitutes bottom of the furnace and can progressively proceed through step-wise rotation. For casting against vertical or strongly inclined surfaces an inner mould wall will, however, be required.

If the surfaces have a pronounced curvature the inner mould wall is suitably made out of thermoplastic boards which in mounting are heated and glued to the top sides of the prefabricated anchoring elements. The anchoring elements may have different heights if the lining shall have varying thickness.

In the cooling section of a cement rotary furnace the refractory lining often has protruding axial walls or cams functioning as lifter bars for the hot cement clinker for improving heat transfer. A lining of this type is called lifter bar lining. In these sections the anchoring elements are designed in a particular manner so as to function also as lifter bar elements. The lifter bars are subjected to high stresses. Therefore, they are made of high-refractory wear resistant ceramic material, e.g. according to U.S. Pat. No. 4,244,745, the disclosure of which is incorporated herein by reference, and they are provided with two or several strong bolts for anchoring to the mantle wall. The elements have a width corresponding to the desired width of the cam and a length which is 1 to 3 times the width. The cam elements have preferably essentially the shape of a parallelepiped, the lower part of the surfaces constituting parts of the longitudinal sides of the cam, however, inclining inwardly. The lower part of the cam elements thereby obtain wedge shape contributing to keeping in position the ceramic casting mass applied between the cams.

When removing the lining the nuts on the bolts extending through the walls of the furnace are loosened. By powerful impacts on the bolts from the exterior side of the furnace the lining is ruptured at the interarea between the prefabricated anchoring elements and the part of the lining cast in situ. Thereby the anchoring irons fall out and also a greater part of the remaining part of the lining no longer anchored follows along. Only a relatively minor postcleaning work with a chipper will be required.

In certain parts of the furnace where the back of the wall of the furnace is not accessible or where for other reasons through-bolts cannot be used the elements are instead attached to sheet forks welded to the wall. In this case the clearing is started by chipping a ditch in the lining adjacent to the sheet wall. Then the lining is chipped away in the adjacent area of the lining in a direction towards the ditch and in direction to the open side of the sheet forks holding the element.

DESCRIPTION OF A PREFERRED EMBODIMENT WITH REFERENCE TO THE APPENDED DRAWING

Figure 1:
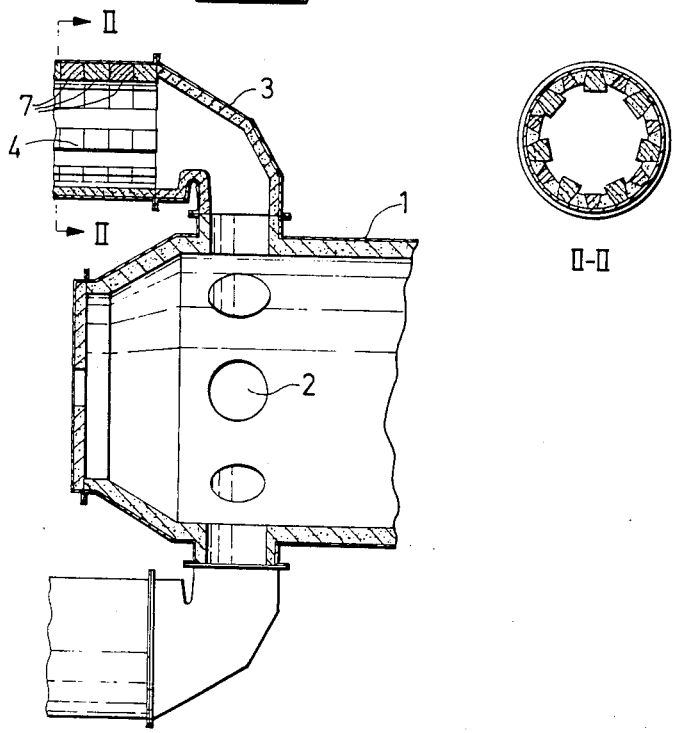
FIG. 1 shows, partly in section, the discharge end of a cement rotary furnace.

According to FIG. 1 a tubular cement rotary furnace 1 is connected to eight satellite coolers 4 through openings 2 and angular elements or so-called cones 3.

Figure 2:
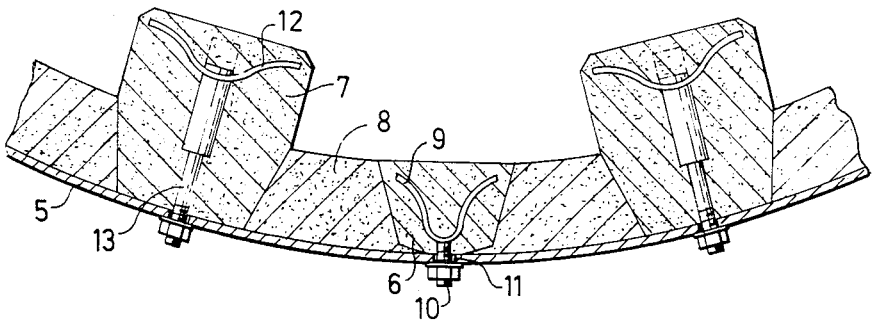
FIG. 2 shows on a larger scale a part of section II—II of the cooler of FIG. 1.
Figure 3:
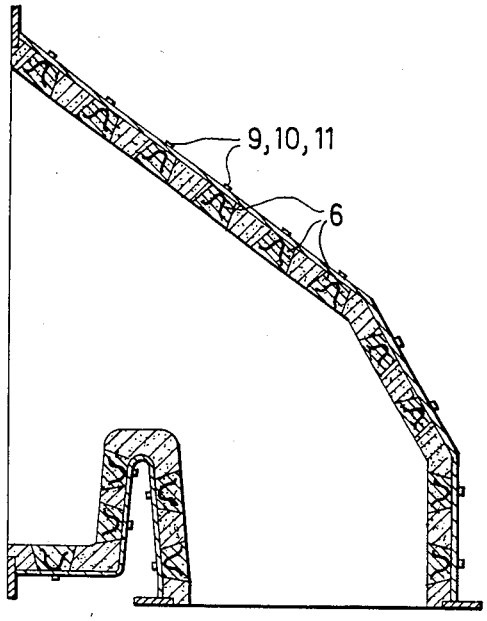
FIG. 3 shows on a larger scale a detail of FIG. 1.
Figure 4:
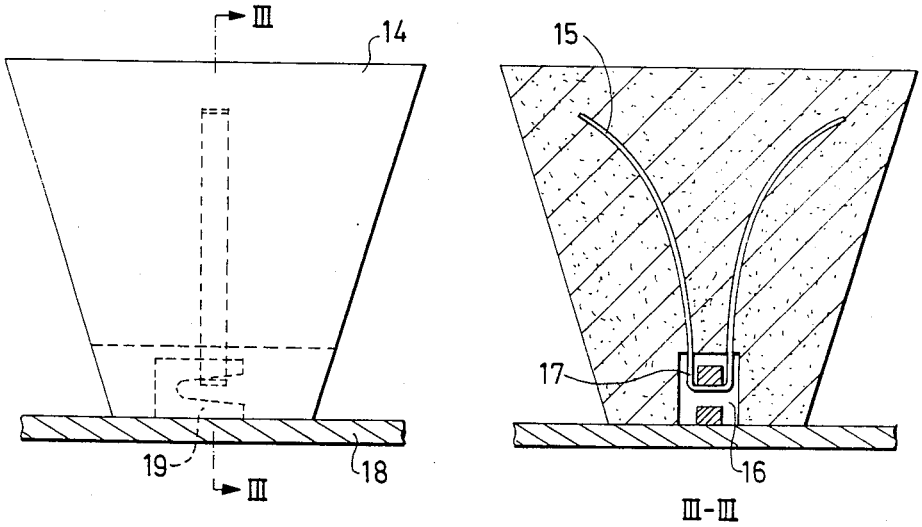
FIG. 4 shows in two side views an embodiment with fork attachment.

As is clear from FIG. 2 coolers 4 consist of a cylindric sheet mantle 5 with an interior ceramic lining. The lining consists of two types of anchoring elements, namely wholly surroundingly cast anchoring elements 6 and cam elements 7 and an intermediary refractory ceramic casting mass 8. Elements 6 are at the same level as the intermediary cast 8. Cam elements 7 extend over the surface of elements 6 and 8. A plurality of elements 7 are arranged adjacent to each other in a row and form a can extending along the length of cooler 4. The juxtaposed side surfaces are thus plane and parallel to each other. The two other juxtaposed side surfaces of the cam elements have upper planar surfaces which are parallel to each other and lower planar surfaces inclining downwardly inwardly.

The conical anchoring element 6 is provided with an attachment device consisting of a flat steel bar 9 which is welded to a bolt 10. The bolt 10 thus extends through a hole 11 drilled in the mantle sheet 5 of the cooler and is attached with a nut.

Cam element 7 is provided with two or several similar fastening devices of flat steel 12 welded to bolts 13. Also said bolts are inserted into holes drilled in the mantle sheet and are drawn with nuts.

A conical anchoring element 14 is provided with another type of fastening device. A flat steel bar 15 is cast into anchoring element 14 and is exposed in a cavity 16 and designed therein as a clamp 17. In mounting the clamp is inserted into a steel fork 19 welded to mantle sheet 18. By hitting a mandrel engaging clamp 17 the anchoring element 14 is wedged up into the fork.

When manufacturing a lining according to the drawing anchoring elements 6, 7 and 14 with accompanying fastening devices are first made by casting a refractory ceramic casting mass. The blocks are allowed to dry and are then attached to a sheet mantle in the desired number of anchoring elements, whereafter a refractory ceramic casting mass 8 is applied between the anchoring elements. Casting mass 8 is then allowed to dry. Burning of the casting mass 8 and the anchoring elements 6, 7 and 14 takes place when heating up the furnace. In this manner a coherent monolithic lining is formed, the removal of which is greatly facilitated by the arrangement of the invention.

We claim:

1. A furnace wall comprising a sheet mantle, a casting mass and means for removing said casting mass from said sheet mantle comprising precast refractory anchoring elements defining a conical or pyramid shape and a cross-section which increases in a direction away from the sheet mantle, said casting mass and said precast refractory anchoring elements cast into a monolithic refractory mass, said precast refractory anchoring elements including bolts extending therefrom and anchoring bars cast into said precast refractory anchoring elements, said bolts extended through holes in said mantle and secured at the exterior of said mantle by removable securing means, said sheet mantle supporting said casting mass and said precast refractory anchoring elements, said monolithic refractory mass anchored to said sheet mantle by said anchoring bars.

2. A furnace wall defined by a sheet mantle, a casting mass and means for removing said casting mass from said sheet mantle comprising precast refractory anchoring elements, said casting mass and said precast refractory anchoring elements cast into a monolithic refractory mass, a plurality of said precast refractory anchoring elements extending above the casting mass and defining a substantially parallelpiped so as to provide a lifter lining, said precast refractory anchoring elements including bolts extending therefrom and anchoring bars cast into said precast refractory anchoring elements, said bolts extended through holes in said mantle and secured at the exterior of said mantle by removable securing means, said sheet mantle supporting said casting mass and said precast refractory anchoring elements, said monolithic refractory mass anchored to said mantle by said anchoring bars.

3. A liner according to claim 1, wherein each bolt has a portion internal of said anchoring element, said anchoring bars affixed to and extending transversely of said internal portion.

4. A lining according to claim 3, wherein said sheet mantle is cylindrical, said cross-section increases in a radially inward direction, and said bolts extend radially outwardly from said anchoring elements through said holes.

5. A lining according to claim 2, wherein each bolt has a portion internal of said anchoring element, said anchoring bars affixed to and extending transversely of said internal portion.

6. A lining according to claim 5, wherein said sheet mantle is cylindrical, said cross-section increases in a radially inward direction, and said bolts extend radially outwardly from said anchoring elements through said holes.

* * * * *